US005261340A

United States Patent [19]

Conley, Jr. et al.

[11] Patent Number: 5,261,340

[45] Date of Patent: Nov. 16, 1993

[54] DETACHABLE TEMPLATE CLAMP HAVING A REMOVABLE SEWING TEMPLATE

[75] Inventors: Ralph F. Conley, Jr., Miamisburg; Gary R. Rader, Cincinnati, both of Ohio

[73] Assignee: MIM Industries, Inc., Miamisburg, Ohio

[21] Appl. No.: 657,136

[22] Filed: Feb. 19, 1991

[51] Int. Cl.[5] ..... D05B 3/00; D05B 21/00

[52] U.S. Cl. ..... 112/121.15; 112/121.12; 112/262.1; 112/114

[58] Field of Search ..... 112/119, 121.15, 121.12, 112/103, 262.1, 262.3, 114; 38/102, 102.1, 102.2; 223/38

[56] References Cited

U.S. PATENT DOCUMENTS

| | | | |
|---|---|---|---|
| 164,241 | 6/1875 | Wheeler . | |
| 278,485 | 5/1883 | Arnold . | |
| 1,222,618 | 4/1917 | Gammons . | |
| 1,387,034 | 8/1921 | Barren et al. . | |
| 1,569,231 | 1/1926 | Mayo . | |
| 2,223,626 | 12/1940 | Ladue | 112/2 |
| 2,630,087 | 3/1953 | Liero et al. | 112/114 |
| 2,726,613 | 12/1955 | Eddy | 112/114 |
| 3,104,637 | 9/1963 | Hedegaard | 112/104 |
| 3,664,283 | 5/1972 | McFalls | 112/121.15 |
| 3,664,288 | 5/1972 | Von Boden et al. | 112/103 |
| 3,799,086 | 3/1974 | Block | 112/121.15 |
| 3,830,175 | 8/1974 | Levor | 112/121.12 |
| 3,875,877 | 4/1975 | Fox | 112/63 |
| 3,875,878 | 4/1975 | Kaminski | 112/116 |
| 3,970,016 | 7/1976 | Yanikoski | 112/121.12 |
| 4,171,672 | 10/1979 | Dorosz et al. | 112/121.12 |
| 4,273,059 | 6/1981 | Kamal | 112/121.14 |
| 4,296,699 | 10/1981 | Vartoukian | 112/121.15 |
| 4,305,338 | 12/1981 | Adamson | 112/113 |
| 4,455,952 | 6/1984 | Monn et al. | 112/121.12 |
| 4,462,320 | 7/1984 | Scholl | 112/104 |
| 4,479,447 | 10/1984 | Rohr | 112/141 |
| 4,493,276 | 1/1985 | Sadeh | 112/121.12 |
| 4,498,407 | 2/1985 | Landwehr et al. | 112/308 |
| 4,503,788 | 3/1985 | Giannuzzi et al. | 112/121.12 |
| 4,534,303 | 8/1985 | Ott et al. | 112/114 |
| 4,603,647 | 8/1986 | Conley, Jr. et al. | 112/129 |
| 4,610,210 | 9/1986 | Kinoshita et al. | 112/121.12 |
| 4,622,907 | 11/1986 | Kimura | 112/121.12 |
| 4,639,964 | 2/1987 | Binder | 112/121.15 X |
| 4,664,045 | 5/1987 | Landwehr et al. | 112/153 |
| 4,682,551 | 7/1987 | Toman | 112/103 |
| 4,696,242 | 9/1987 | Scholl et al. | 112/121.14 |
| 4,706,583 | 11/1987 | Darbenzio | 112/103 |
| 4,708,072 | 11/1987 | Frye | 112/121.27 |
| 4,763,587 | 8/1988 | Frye | 112/121.12 |
| 4,799,438 | 1/1989 | Hishchle | 112/121.12 |
| 4,854,251 | 8/1989 | Hiramatsu et al. | 112/121.12 |
| 4,870,917 | 10/1989 | Frye | 112/121 |
| 4,883,006 | 11/1989 | Marii et al. | 112/121.12 |
| 4,920,904 | 5/1990 | Frey | 112/262.1 |
| 4,989,525 | 2/1991 | Portilla | 112/10 |
| 5,005,501 | 4/1991 | Kita | 112/121.12 |
| 5,014,633 | 5/1991 | Murata et al. | 112/121.12 |
| 5,101,746 | 4/1992 | Frye | 112/114 X |
| 5,127,348 | 7/1992 | Scholl et al. | 112/121.12 |

OTHER PUBLICATIONS

*The Technologies of MIM Industries, Inc.* Sales Brochure, published approximately Jan. 1, 1990.

*Primary Examiner*—Clifford D. Crowder
*Assistant Examiner*—Paul C. Lewis
*Attorney, Agent, or Firm*—Biebel & French

[57] ABSTRACT

A method and apparatus comprising a detachable sewing template clamp for sewing a workpiece, like a label, on an article using a programmable sewing machine. The detachable sewing template clamp comprises a generally U-shaped frame member which is detachably mounted to the programmable sewing machine. The template clamp has a support which is capable of removably securing a sewing template to the generally U-shaped frame member. The sewing template defines a predetermined stitch pattern corresponding to the shape of the workpiece, and the template clamp permits the sewing template to be easily removed and changed whenever the predetermined stitch pattern changes. The template clamp permits the sewing template to be detachably secured thereto so that the sewing machine can stitch the predetermined stitch pattern in the workpiece.

10 Claims, 5 Drawing Sheets

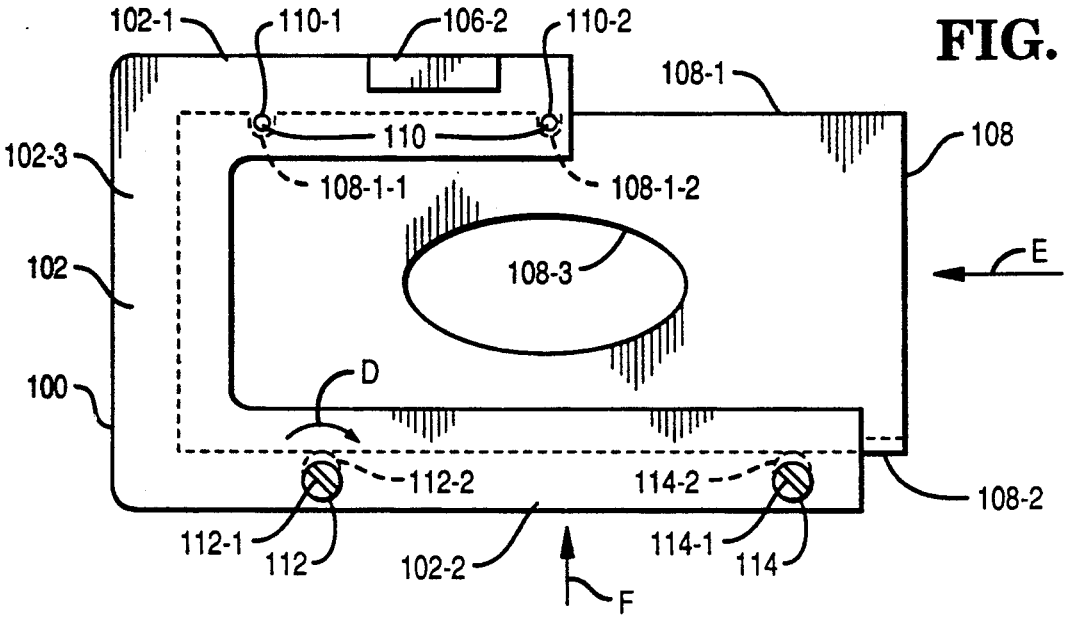
FIG. 5
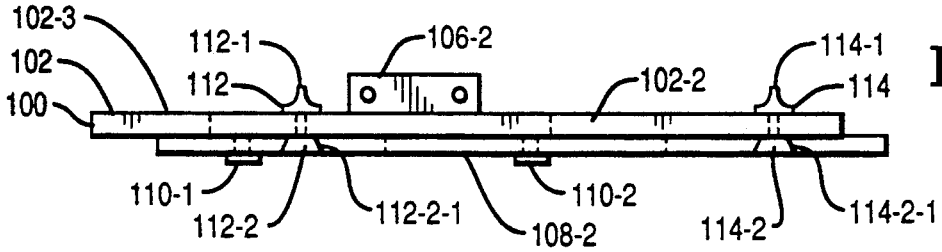
FIG. 6
FIG. 7
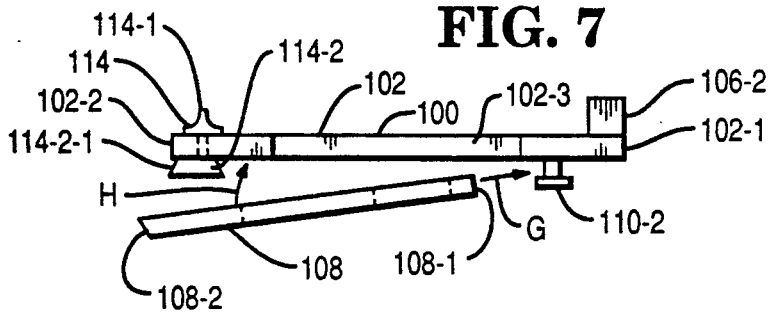
FIG. 9
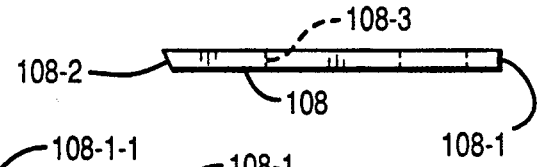
FIG. 8
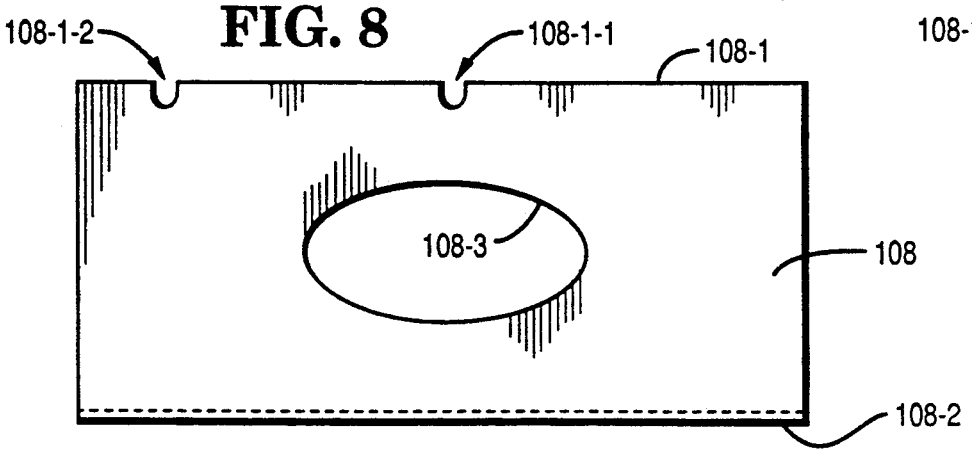

DETACHABLE TEMPLATE CLAMP HAVING A REMOVABLE SEWING TEMPLATE

BACKGROUND OF THE INVENTION

1. Field of the Invention.

This invention relates to a detachable template clamp for use in a sewing machine, and more particularly, it relates to a detachable template clamp having a removable sewing template which defines a predetermined stitch pattern.

2. Description of Related Art.

In the sewing industry, a common repetitive function is to sew a label or workpiece on a panel of material, such as a shirt, jacket or hat. To facilitate producing a large number of identical, finished panels, it became necessary to attach a clamp frame to the sewing machine. The clamp frame typically held the label against the panel, and it provided a template of the sewing pattern to be sewn on the label and panel. A typical clamp frame consisted of four sides defining an inner perimeter which surrounded a rectangular open area of the same size and shape as the label to be sewn to the panel. A label would be placed on the panel and the clamp frame would clamp the periphery of the label against the panel. A separate and independent arm or plate would engage a central part of the label and hold it down inside the rectangular open area. Once the label was secured inside the rectangular open area, the sewing machine would then sew stitches between the independent plate and the inner perimeter of the clamp frame. Because labels usually have different shapes and sizes, each label would require its own clamp frame which had a sewing pattern which fit that label. Thus, whenever a different label was to be sewn onto the panel, it was necessary to change the entire clamp frame.

Another problem with clamp frames of the prior art is that they were typically attached by machine screws to a clamp foot that is moved up and down to release and grip the panel onto which the label is to be sewn. Thus, whenever a clamp foot is changed, an operator would have to unscrew the machine screws, remove the clamp frame, align a different clamp frame with the clamp foot, and reinsert and tighten the screws. During all this time, the machine is inoperative and the resultant down-time can make the resulting sewn products excessively expensive and non-competitive.

SUMMARY OF THE INVENTION

An object of this invention is to provide a template clamp which provides a sewing template which can be quickly and easily changed whenever a label to be sewn on a workpiece is changed.

In one aspect, this invention includes: a sewing template for use in a sewing machine comprising a needle, a clamping surface, a template clamp associated with the clamping surface for securing a workpiece against the clamping surface in operative relationship with the needle; said sewing template comprising: a body member having a predetermined stitch pattern therein; securing means for detachably securing the body member to the template clamp; said securing means permitting the body member to be detachably secured to the template clamp so that the sewing template will be in operative relationship with the needle, thereby enabling the sewing machine to stitch the predetermined stitch pattern in the workpiece.

In another aspect, this invention includes: a method for using a sewing machine to sew a predetermined stitch pattern on a workpiece, said sewing machine comprising a sewing station, a clamping surface, a needle, a template clamp for securing the workpiece against the clamping surface so that the workpiece is operatively related to the needle, and securing means for detachably securing a sewing template of the predetermined stitch pattern to the template clamp; said method comprising the steps of: (a) selecting the sewing template; (b) securing the sewing template to the template clamp with the securing means; and (c) sewing the predetermined stitch pattern on the workpiece.

Another object of this invention is to provide a template clamp for securing a workpiece against a clamping surface of a sewing machine, whereby the template clamp provides a sewing template which can be quickly changed, without having to dismount the template clamp from the sewing machine.

Another object of this invention is to provide a template clamp that will allow a sewing template to be changed by the operator without using any tools.

Another object of this invention is to provide a template clamp that is easy and inexpensive to manufacture.

Still another object of this invention is to provide a sewing template which can be easily secured to a template clamp.

Yet another object of this invention is to provide a method which permits an operator to quickly and easily change a sewing template in a sewing machine, thereby improving the operators efficiency in using the sewing machine.

These objects, and others, may be more readily understood in connection with the following specification, claims, and drawing.

BRIEF DESCRIPTION OF THE DRAWING

FIG. 5 is a top view of a template clamp detached from the sewing machine, showing a sewing template mounted in a frame member;

FIG. 6 is a front view, taken in the direction of arrow F in FIG. 5, showing details of the means for securing the sewing template to the frame member;

FIG. 7 is an end view, taken in the direction of arrow E in FIG. 5, showing how the sewing template mounted in the frame member;

FIG. 8 is a top view of the sewing template removed from the frame member; and FIG. 9 is a right side view of the sewing template shown in FIG. 8.

DESCRIPTION OF THE PREFERRED EMBODIMENT

Figure 1:
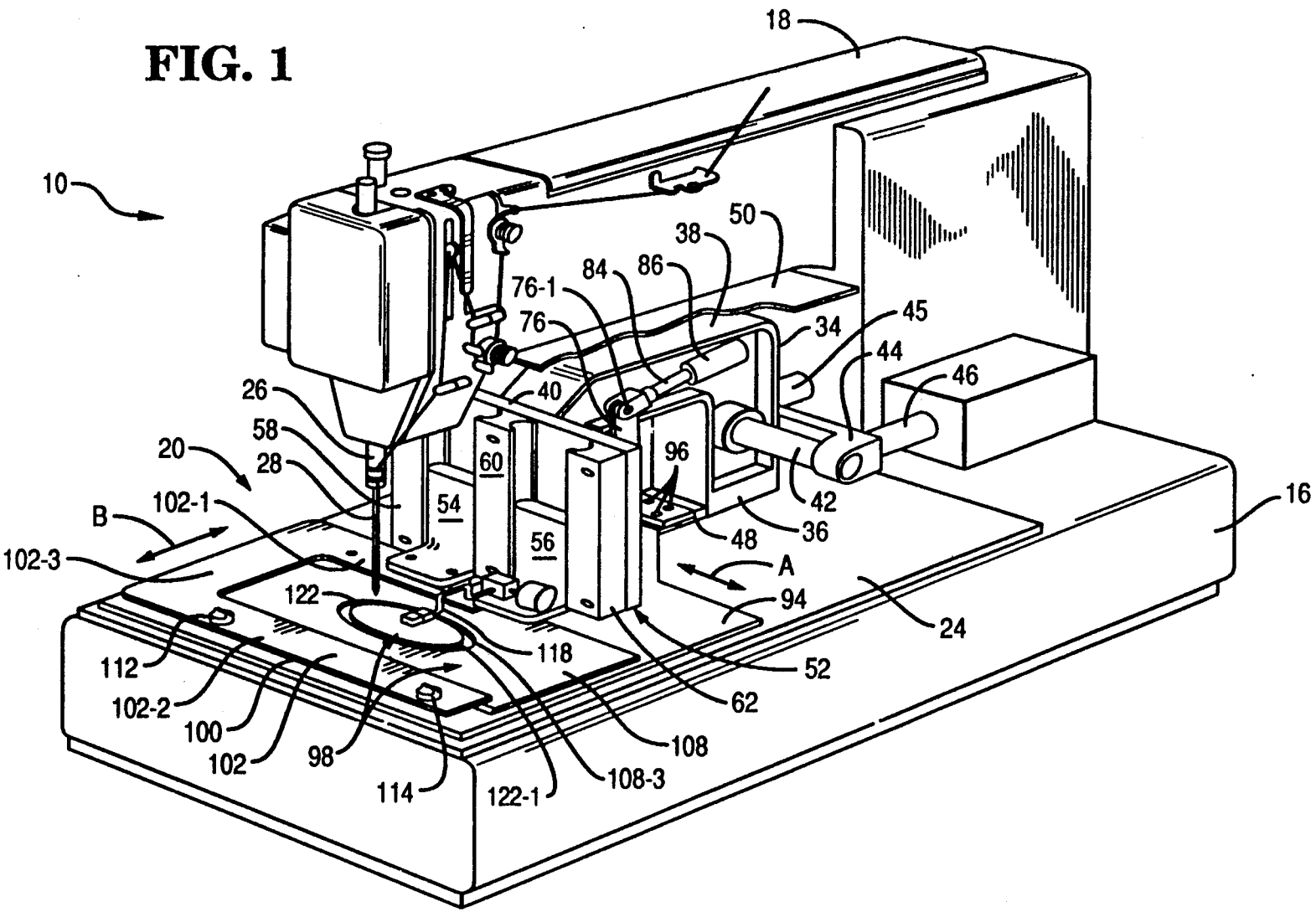
FIG. 1 is a perspective view of a sewing machine in which a preferred embodiment of this invention may be used.

FIG. 1 shows a perspective view of a programmable sewing machine, hereinafter designated as sewing machine 10, in which a preferred embodiment of this invention may be used. The function of the sewing machine 10 is to sew a predetermined stitch pattern 12 (FIG. 4) on a workpiece 14, such as a label, according to a computer program (not shown) which is controlled by a master controller (not shown) in the sewing machine 10 (FIG. 1). In the embodiment being described, the sewing machine 10 may be any of the Brother BAS Series 300 programmable sewing machines, such as the BAS Model 340, which are manufactured by Brother Industries of Japan. The sewing machine 10 comprises a base 16 having a horizontal arm 18 secured thereto. The sewing machine 10 also comprises a sewing station 20 at which the workpiece 14 (FIG. 4) can be sewn onto a panel of material or article 22, such as cloth (like a hat, jacket, or other garment), plastic, rubber or any other material which is capable of being sewn. The sewing station 20 is comprised of a sewing surface 24 which supports the article 22 and the workpiece 14 while the workpiece 14 is being sewn on the article 22. As best illustrated in FIG. 1, the horizontal arm 18 extends out over the sewing surface 24, and it has a needle holder 26 near the end thereof. The needle holder 26 supports a needle 28 for reciprocating motion in a fixed path that is generally vertical and perpendicular to the sewing surface 24. The needle 28 moves down through a hole (not shown) in a throat plate (not shown) at the bottom of its stroke to transfer a loop of thread to a looptaker (not shown) under the sewing surface 24. The looptaker and needle 28 are both connected to a motor (not shown) which is controlled the master controller (not shown) in the sewing machine 10.

The sewing machine 10 further comprises a work holder support 34 having a base portion 36, an arm portion 38, and an end portion 40. The base portion 36 is slidably mounted on a shaft 42 which is supported by a yoke 44. The base portion 36 may be caused to slide along the shaft 42 to permit the work holder support 34 to move in an X direction, indicated by double arrow A in FIG. 1. The yoke 44 is coupled to a second shaft 5 and a third shaft 46 which can cause the yoke 44 and base portion 36 to move in a Y direction, indicated by double arrow B in FIG. 1. The second and third shafts 45 and 46 are coupled to a stepper motor (not shown) by various belts, gears and pulleys (not shown) in the sewing machine 10.

The base portion 36 of the work holder support 34 is coupled to a carriage 48 in the base 16 of the sewing machine 10 by conventional fasteners. The carriage 48 is coupled by various belts, gears and pulleys (not shown) to a second stepper motor (not shown) within the base 16. The second stepper motor moves the carriage 48 which in turn causes the work holder support 34 to move in the X direction. The stepper motor (not shown) and second stepper motor (not shown) are both coupled to the master controller (not shown) in the sewing machine 10. The master controller can selectively energize the stepper motor and second stepper motor to move in the X or Y directions, either individually or simultaneously, thereby permitting the sewing machine 10 to sew the predetermined stitch pattern 12.

As best shown in FIG. 1, the sewing machine 10 also comprises a plate 50 which may be secured to the sewing machine 10 by any conventional fastener, such as machine screws (not shown). The work holder support 34 has a top edge or surface 34-1 (FIG. 2) which slidably engages the plate 50 when the work holder support 34 moves in the X and Y directions. The function of the plate 50 is to support the arm portion 38 of the work holder support 34 so that the end portion 40 does not move away from the base 16 during a clamping operation to be described later herein.

Figure 2:
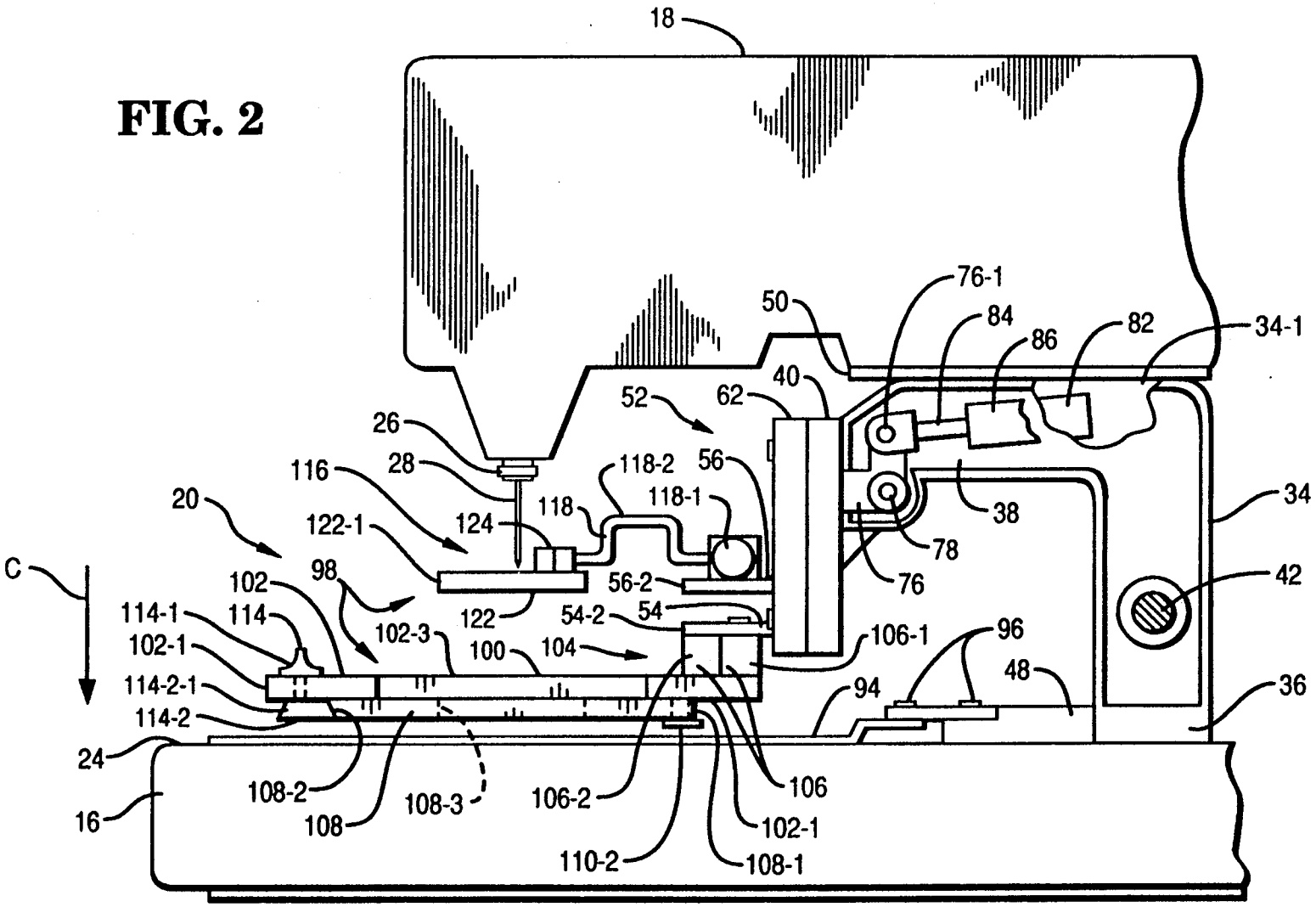
FIG. 2 is partly broken away side view of a fragment of the sewing machine shown in FIG. 1, showing one embodiment of a template clamp used on the sewing machine.
Figure 3:
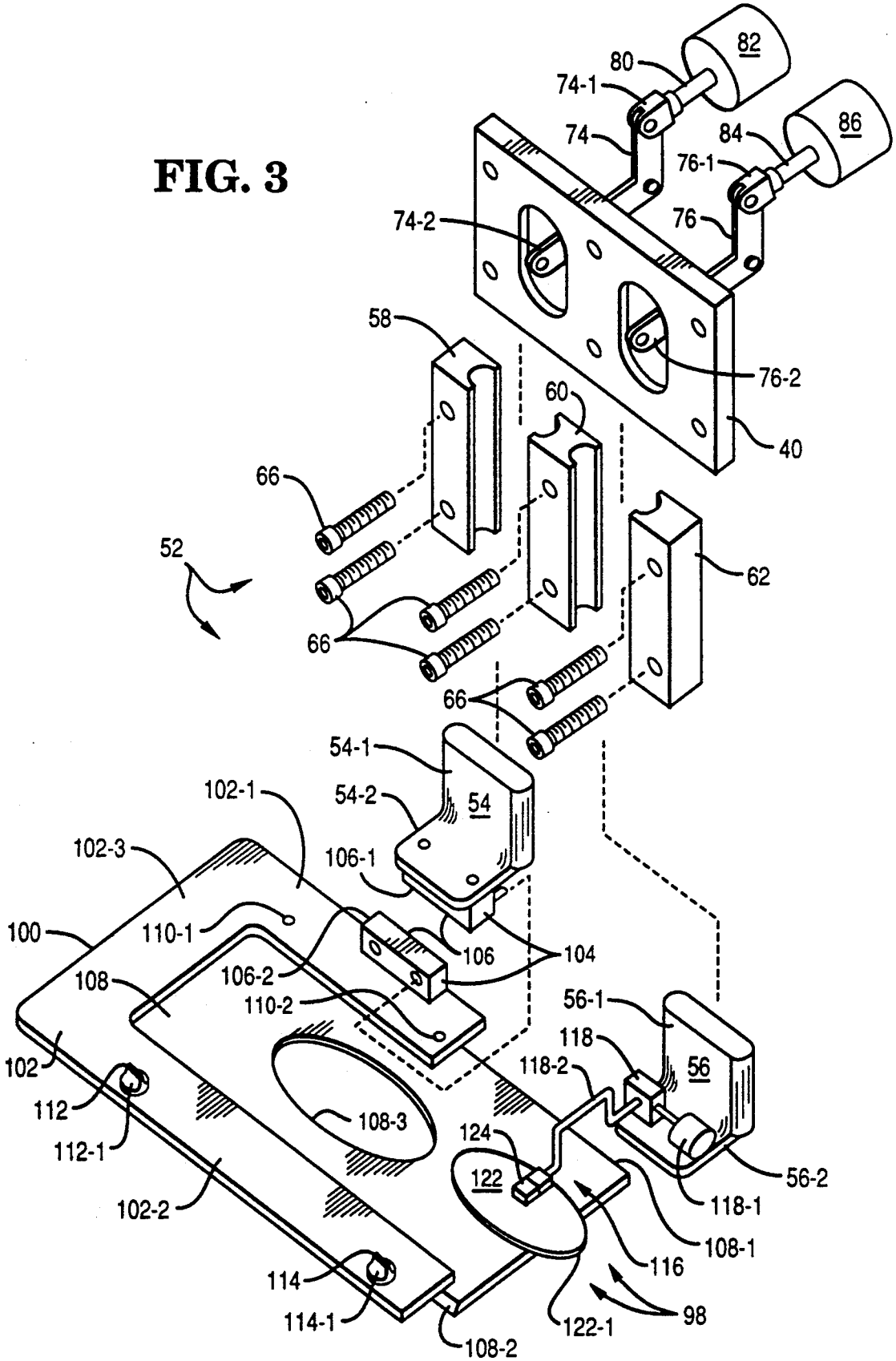
FIG. 3 is a perspective exploded view of a portion of the sewing machine shown in FIGS. 1 and 2.

The end portion 40 comprises supporting means 52 (FIG. 2) for slidably supporting a first L-shaped bracket 54 and a second L-shaped bracket 56. The first L-shaped bracket 54 has a first bracket portion 54-1 (FIGS. 3 and 4) and a second bracket portion 54-2. The second L-shaped bracket 56 has a third bracket portion 56-1 and a fourth bracket portion 56-2. As best illustrated in FIG. 3, the supporting means 52 comprises a first sleeve 58, a second sleeve 60 and a third sleeve 62 which slidably support the first and second L-shaped brackets 54 and 56. The first, second and third sleeves 58, 60 and 62 are secured to the end portion 40 by machine screws 66, as best illustrated in FIG. 2. The first bracket portion 54-1 is slidably mounted between the first and second sleeves 58 and 60 as shown. Likewise, the third bracket portion 56-1 is slidably mounted between the second and third sleeves 60 and 62. The second and fourth bracket portions 54-2 and 56-2 extend away from the end portion 40 so as to be in a generally parallel relationship with the sewing surface 24.

Figure 4:
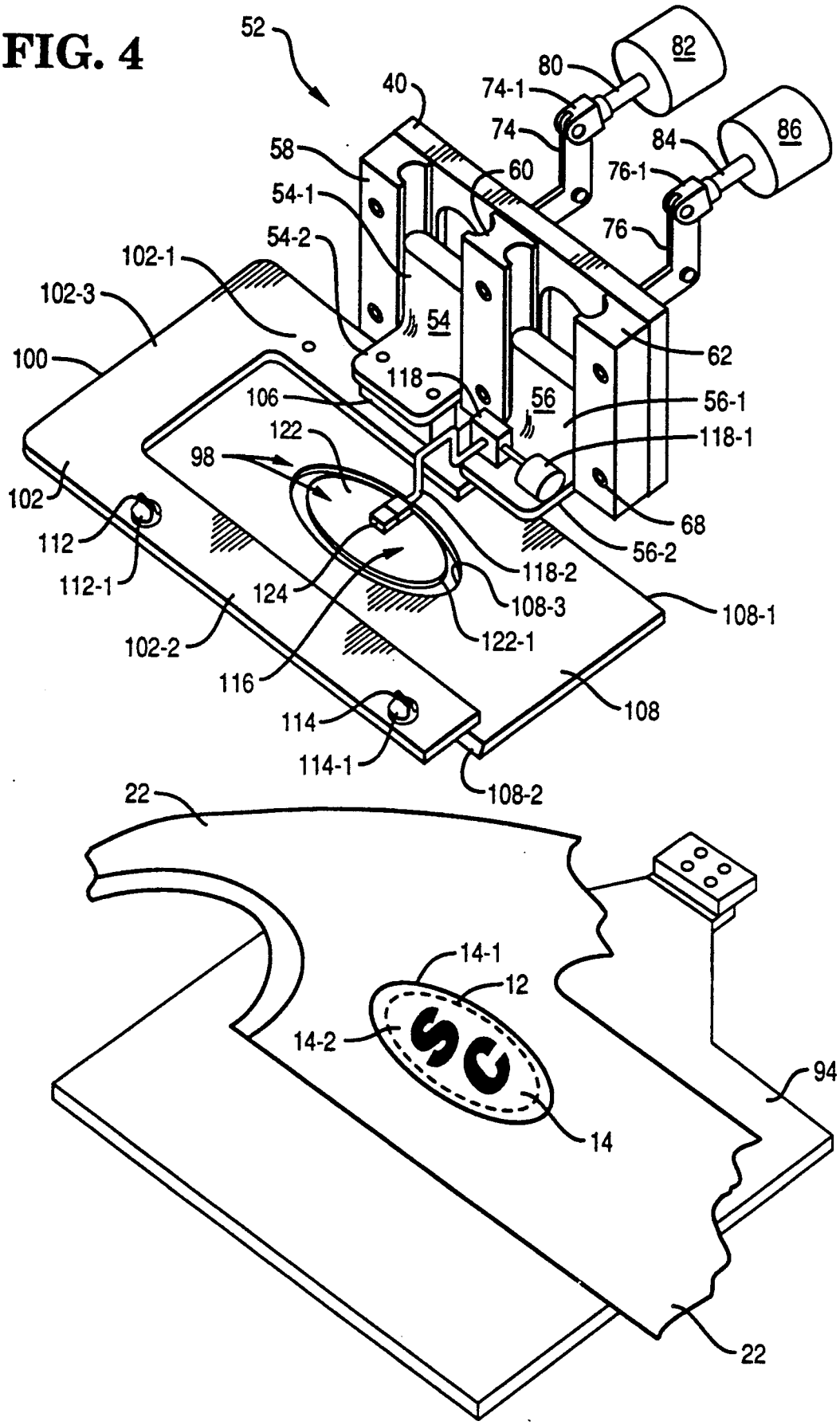
FIG. 4 is a perspective assembled view of the portion of the sewing machine shown in FIG. 3, showing a workpiece sewn onto an article with a predetermined stitch pattern.

As illustrated in FIGS. 3 and 4, a first pivot arm 74 and a second pivot arm 76 are pivotally secured by a pin 78 (FIG. 2) to the end portion 40. The first pivot arm 74 (FIGS. 3 and 4) has one end 74-1 secured to an armature 80 of a first solenoid 82 and another end 74-2 secured to the first bracket portion 54-1 of the first shaped bracket 54. The second pivot arm 76 has one end 76-1 secured to an armature 84 of a second solenoid 86 and another end 76-2 secured to the third bracket portion 56-1 of the second L-shaped bracket 56. The first and second solenoids 82 and 86 are conventionally secured to the end portion 40 by machine screws (not shown). The first and second solenoids 82 and 86 are conventionally connected to the master controller (not shown). When the master controller energizes the first solenoid 82, the armature 80 causes the first pivot arm 74 to pivot which in turn causes the first L-shaped bracket 54 to move downward towards the sewing surface 24 (FIGS. 1 and 2) in the direction of arrow C in FIG. 2. The master controller may also energize the first solenoid 82 to pull the armature 84, thereby causing the first L-shaped bracket 54 to move upward in the direction opposite that indicated by arrow C. The master controller can energize the second solenoid 86 to move the second L-shaped bracket 56 in the same manner, and it can selectively energize the first and second solenoids 82 and 86 simultaneously or independently.

The base portion 36 of the work holder support 34 (FIG. 1) also has a planar member or cloth plate 94 secured thereto by suitable fasteners, such as screws 96. In the embodiment being described, the cloth plate 94 is a generally planar wire mesh which slides over the sewing surface 24 in response to the movement of the base portion 36. The cloth plate 94 provides a clamping surface which cooperates with a template clamp 100 to secure the workpiece 14 and article 22 at the sewing station 20.

A preferred embodiment of this invention comprises work holder means 98 (FIG. 2) for holding the workpiece 14 (FIG. 4) against the article 22 and the cloth plate 94. The work holder means 98 comprises the template clamp 100 for securing a perimeter 14-1 of the workpiece 14 against the article 22 and also for securing the article 22 against the cloth plate 94. The template clamp 100 comprises a frame member 102 which is generally U-shaped and which is made of aluminum in the embodiment being described, but it could be made of any suitable material that is capable of performing the same function. As best illustrated in FIG. 5, the frame member 102 comprises a first leg portion 102-1, a second leg portion 102-2, and a joining portion 102-3 joining said first and second leg portions 102-1 and 102-2.

The template clamp 100 further comprises mounting means 104 (FIG. 2) for mounting the template clamp 100 to the second bracket portion 54-2 of the first L-shaped bracket 54. In the embodiment being described, the mounting means 104 includes a first quick disconnect member 106. The first quick disconnect member 106 has a male member 106-1 secured to the second bracket portion 54-2 by suitable fasteners such as machine screws. The first quick disconnect member 106 also has a female member 106-2 which is secured to the first leg portion 102-1 by suitable fasteners such as machine screws. As best illustrated in FIG. 4, the female member 106-2 cooperates with the male member 106-1 to rigidly secure the frame member 102 to the second bracket portion 54-2 of the first L-shaped bracket 54. In the embodiment being described, the structure and operation of the first quick disconnect member 106 is similar to the release mechanisms shown and described in U.S. Pat. No. 4,763,587, issued on Aug. 16, 1988, and U.S. Pat. No. 4,870,917, issued on Oct. 3, 1989, which are assigned to the same assignee as the present application and which are hereby incorporated by reference and made a part hereof. Although the mounting means 104 in the embodiment being described herein includes the first quick disconnect member 106, the mounting means 104 could be any suitable fastener, such as screws (not shown) or an adhesive (not shown), which is capable of securing the frame member 102 to the second bracket portion 54-2.

The template clamp 100 (FIG. 5) further comprises a sewing template 108 which is generally rectangular and which defines or provides a template of the predetermined stitch pattern so that neither the article 22 nor the workpiece 14 begins tenting as the needle 28 is withdrawn during the formation of each stitch. The sewing template 108 has a first opposed side 108-1 and a second opposed side 108-2. The second opposed side 108-2 is beveled, as best shown in FIG. 9, to facilitate mounting the sewing template 108 securely against the frame member 102. The first opposed side 108-1 has a first notched-out portion 108-1-1 and a second notched out portion 108-1-2. In the embodiment being described, the sewing template 108 is made of plastic, but it could be made of aluminum or any suitable material that is capable of performing the same function.

The template clamp 100 (FIG. 5) also comprises a support or securing means 110 located on the frame member 102 for detachably securing the sewing template 108 to the frame member 102. The securing means 110 permits the sewing template 108 to be detachably secured in the frame member 102 so that, when the frame member 102 is detachably mounted to the sewing machine 10, the template clamp 100 is capable of securing the workpiece 14 against the cloth plate 94 in operative relationship with the needle 28 of the sewing machine 10. This feature enables the sewing machine 10 to use the sewing template 108 to stitch the predetermined stitch pattern 12 in the workpiece 14. In the embodiment being described, the securing means 110 comprises a first support post 110-1 and a second support post 110-2 which depend from the first leg portion 102-1 as shown. The securing means 110 also comprises a first actuating member 112 and a second actuating member 114. As best illustrated in FIG. 6, the first actuating member 112 comprises a first grip member 112-1 and a first camming member 112-2, and the second actuating member 114 comprises a second grip member 114-1 and a second camming member 114-2. The first and second camming members 112-2 and 114-2 have a first beveled edge 112-2-1 and a second beveled edge 114-2-1. The first and second beveled edges 112-2-1 and 114-2-1 cooperate with the second opposed side 108-2 (FIG. 9) to secure the sewing template 108 firmly against the frame member 102. When the first and second grip members 112-1 and 114-1 are rotated in a camming direction, indicated by arrow D in FIG. 5, the first and second camming members 112-2 and 114-2 force the first and second notched out portions 108-1-1 and 108-1-2 against the first and second support posts 110-1 and 110-2, respectively, thereby securing the sewing template 108 to the frame member 102.

In the embodiment being described, the work holder means 98 (FIG. 2) also comprises a workpiece clamp 116. The function of the workpiece clamp 116 is to secure a central portion 14-2 of the workpiece 14 against the article 22 so that the workpiece 14 does not tent or pull away from the article 22 when the needle 28 is withdrawn therefrom during the stitching operation. The workpiece clamp 116 comprises a 360 degree connector 11 (FIG. 4) which is conventionally secured to the fourth bracket portion 56-2 of the second L-shaped bracket 56. The 360 degree connector 118 is coupled to a foot plate 122 by a second quick disconnect member 124. The second quick disconnect member 124 operates in the same manner as the first quick disconnect member 106 described previously herein. The foot plate 122 has an outer edge 122-1 which generally outlines the shape of the central portion 14-2 of the workpiece 14. The 360 degree connector 118 has a solenoid 118-1 which is conventionally coupled to the master controller (not shown). The master controller can energize the solenoid 118-1 which causes a C-shaped pivot arm 118-2 to pivot or "flip flop". This enables the sewing machine 10 to sew a 360 degree stitch pattern if desired. The method of operation for sewing the predetermined stitch pattern 12 on the workpiece 14 will now be described.

As best shown in FIGS. 3 and 4, The template clamp 100 is secured to the second bracket portion 54-2 of the first L-shaped bracket 54 with the first quick disconnect member 106. Likewise, workpiece clamp 116 is coupled to the fourth bracket portion 56-2 of the second L-shaped bracket 56 with the second quick disconnect member 124. The sewing template 108 corresponding to the predetermined stitch pattern 12 is then selected. The first and second notched-out portions 108-1-1 and 108-1-2 are aligned with the first and second support posts 110-1 and 110-2, respectively, as shown in FIG. 7. The sewing template 108 is then moved in the direction of arrow G in FIG. 7 until the first and second notched-out portions 108-1-1 and 108-1-2 engage the first and second support posts 110-1 and 110-2, respectively. The sewing template 108 is then pivoted in the direction of arrow H until the second opposed side 108-2 of the sewing template 108 engages the second leg portion 102-2. The first and second grip members 112-1 and 114-1 are rotated in the camming direction, thereby detachably securing the sewing template 108 to the template clamp 100. After the article 22 (FIG. 4) is placed between the cloth plate 94 and the template clamp 100. The workpiece 14 is placed on the article 22. The master controller (not shown) may then energize the first solenoid 82 to cause the sewing template 108 to engage the perimeter 14-1 of the workpiece 14 to force the workpiece 14 and the article 22 firmly against the cloth plate 94. The master controller may then energize the second solenoid 86 to cause the workpiece clamp 116 to force the central portion 14-2 of the workpiece 14 firmly against the cloth plate 94. Now that the workpiece 14 is firmly secured against the article 22, the master controller may cause them to move in the X and Y direction in accordance with the program (not shown) of the predetermined stitch pattern 12. When the template clamp 100 and the workpiece clamp 116 have the workpiece 14 secured against the article 22, it is possible to form stitches anywhere within the area bounded by the an interior edge 108-3 of the sewing template 108 and the outer edge 122-1 of the foot plate 122. This procedure may be done on a single article 22, workpiece 14 or other small panel gripped between the cloth plate 94 and the template clamp 100. After the predetermined stitch pattern 12 is sewn in the workpiece 14, the master controller causes the template clamp 100 and the workpiece clamp 116 to release the workpiece 14 and the article 22 so that they can be removed from between the cloth plate 94 and the template clamp 100. Another workpiece 14 and article 22 may then be moved into the sewing station 20 where they may be sewn.

When the program (not shown) in the sewing machine 10 (FIG. 1) is changed in order to cause the sewing machine 10 to sew a new or different predetermined sewing pattern, the sewing template 108 can easily be changed, without having to dismount the frame member 102 from the sewing machine 10. The first and second grip members 112-1 and 114-1 are rotated in a direction opposite the camming direction, and the sewing template 108 is removed from the template clamp 100. A new sewing template 108, corresponding to the new predetermined stitch pattern 12, can then be secured to the frame member 102 of template clamp 100 in the manner described previously herein.

Various changes or modifications in the invention described may occur to those skilled in the art without departing from the spirit or scope of the invention. The above description of the invention is intended to be illustrative and not limiting, and it is not intended than the invention be restricted thereto but that it be limited only by the true spirit and scope of the appended claims.

What is claimed is:

1. A template clamp for securing a workpiece against a clamping surface in a sewing machine in operative relationship with a needle in the sewing machine and also for receiving a sewing template which defines a predetermined stitch pattern, said template clamp comprising:

a frame member;

securing means located on said frame member for detachably securing said sewing template to said frame member; and mounting means located on said frame member for mounting said frame member to said sewing machine;

said securing means detachably securing said sewing template to said frame member, and said template clamp securing the workpiece against the clamping surface in operative relationship with the needle of the sewing machine so that said predetermined stitch pattern can be sewn in said workpiece;

said frame being generally U-shaped and comprising a first leg portion, a second leg portion, and a joining portion joining said first and second leg portions; said securing means securing said sewing template between said first and second leg portions;

said sewing template being generally rectangular and comprises first and second opposed sides;

said securing means further comprising:

at least one support member located on said first leg portion;

at least one actuating member located on said second leg portion, said actuating member engaging said first opposed side and forcing said second opposed side against said at least one support member, thereby securing said sewing template between said first and second leg portions.

2. The template clamp as recited in claim 1 wherein said at least one support member comprises a support post which depends from said first leg portion;

said sewing template comprising at least one notched-out portion which engages said support post when said sewing template is secured to said frame member.

3. A template clamp for securing a workpiece against a clamping surface in a sewing machine in operative relationship with a needle in the sewing machine and also for receiving a sewing template which defines a predetermined stitch pattern, said template clamp comprising:

a frame member having a first leg portion and a second leg portion;

securing means located on said frame member for detachably securing said sewing template to said frame member; and mounting means located on said frame member for mounting said frame member to said sewing machine;

said securing means detachably securing said sewing template to said frame member, and said template clamp securing the workpiece against the clamping surface in operative relationship with the needle of the sewing machine so that said predetermined stitch pattern can be sewn in said workpiece;

said sewing template being generally rectangular and comprising first and second opposed sides;

said securing means further comprising:

at least one support member located on said first leg portion;

at least one actuating member located on said second leg portion, said actuating member engaging said first opposed side and forcing said second opposed side against said at least one support member, thereby securing said sewing template between said first and second leg portions;

said at least one actuating member including a cam member and a grip member, said cam member having a cam member edge which engages said first opposed side of said sewing template and forces said second opposed side against said at least one support member when said grip member is rotated in a camming direction.

4. The template clamp as recited in claim 3 wherein said cam member edge and said first opposed side are both beveled in order to facilitate securing said sewing template in said frame member.

5. A sewing template for use in a sewing machine comprising a needle, a clamping surface, a template clamp associated with said clamping surface for securing a workpiece against the clamping surface in operative relationship with the needle; said sewing template comprising:

a body member having a predetermined stitch pattern therein;

securing means for permitting said body member to be detachably secured to the template clamp;

said securing means permitting said body member to be detachably secured to said template clamp so that said sewing template will be in operative relationship with the needle, thereby enabling the sewing machine to stitch said predetermined stitch pattern in said workpiece;

said sewing template being generally rectangular and comprises first and second opposed sides;

said template clamp is generally U-shaped comprising a first leg portion, a second leg portion, and a joining portion joining said first and second leg portions;

said first leg portion having at least one support member thereon; said at least one support member comprising a support post depending from said first leg portion;

said sewing template comprising at least one notched-out potion which engages said support post when said sewing template is secured to the template clamp.

6. The sewing template as recited in claim 5 wherein said sewing template is made of plastic.

7. A method for sewing a predetermined stitch pattern on a workpiece, said method comprising the steps of:

(a) selecting a sewing template;

(b) inserting said sewing template between a first leg portion and a second leg portion of a template clamp which is coupled to a sewing machine;

said securing step (b) further comprising the steps of:

(b) (1) utilizing securing means to secure said sewing template between said first and second leg portions; and (c) sewing said predetermined stitch pattern on said workpiece;

said at least one actuating member including a cam member and a grip member, said cam member having a cam member edge which engages the first opposed side of the sewing template when the sewing template is secured to the template clamp;

said securing step (b) further comprising the step of:

(b) (3) rotating said grip member in a camming direction to force said second opposed side against said at least one support member.

8. A sewing template clamp for use in a programmable sewing machine, said sewing template clamp comprising:

a frame member;

a support located on said frame member for detachably supporting and securing at least one of a plurality of sewing templates to said frame member, each of said plurality of sewing templates defining a different predetermined stitch pattern; and a mounting member located on said frame member for mounting said frame member to said programmable sewing machine;

said frame member being generally U-shaped comprising a first leg portion, a second leg portion, and a joining portion joining said first and second leg portions; said support securing said sewing template between said first and second leg portions;

said sewing template being generally rectangular and comprises first and second opposed sides;

said support further comprising:

at least one support member located on said first leg portion;

at least one actuating member located on said second leg portion, said actuating member engaging said first opposed side and forcing said second opposed side against said at least one support member, thereby securing said sewing template between said first and second leg portions.

9. The template clamp as recited in claim 8 wherein said at least one support member comprises a support post upstanding from said first leg portion;

said sewing template comprising at least one notched-out portion which engages said support post when said sewing template is secured to said frame member.

10. A sewing template clamp for use in a programmable sewing machine, said sewing template clamp comprising:

a frame member;

a support located on said frame member for detachably supporting and securing at sewing template to said frame member, said sewing template defining a predetermined stitch pattern; and a mounting member located on said frame member for mounting said frame member to said programmable sewing machine;

said sewing template being detachably secured to said frame member so that when said frame member is mounted to said sewing machine said sewing template clamp is capable of being used to secure the workpiece against a clamping surface in the sewing machine, thereby enabling the sewing machine to stitch said predetermined stitch pattern in said workpiece;

said frame member being generally U-shaped comprising a first leg portion, a second leg portion, and a joining portion joining said first and second leg portions; said support securing said sewing template between said first and second leg portions;

said sewing template being generally rectangular and comprising first and second opposed sides;

said support further comprising:

at least one support member located on said first leg portion;

at least one actuating member located on said second leg portion, said actuating member engaging said first opposed side and forcing said second opposed side against said at least one support member, thereby securing said sewing template between said first and second leg portions;

said at least one support member comprising a support post upstanding from said first leg portion;

said sewing template comprising at least one notched-out portion which engages said support post when said sewing template is secured to said frame member;

said at least one actuating member including a cam member and a grip member, said cam member having a cam member edge which engages said first opposed side of said sewing template and forces said second opposed side against said at least one support member when said grip member is rotated in a camming direction.

* * * * *

UNITED STATES PATENT AND TRADEMARK OFFICE

CERTIFICATE OF CORRECTION

PATENT NO. : 5,261,340

DATED : November 16, 1993

INVENTOR(S) : Ralph F. Conley, Jr. and Gary R. Rader

It is certified that error appears in the above-identified patent and that said Letters Patent is hereby corrected as shown below:

In claim 5, col. 9, line 35, please delete "potion" and insert --portion-- therefor.

In claim 10, col.10, line 34, please delete "at" and insert --a-- therefor.

In claim 7, col. 9, line 47, please delete "securing" and insert --inserting-- therefor.

In claim 7, col. 9, line 55, please delete "the" and insert --a-- therefor.

In claim 7, col. 9, line 58, please delete "securing" and insert --inserting-- therefor.

In claim 7, col. 9, line 60, before "second opposed side" please delete "said" and insert --a-- therefor.

In claim 7, col. 9, line 60, after "against" please delete "said".

Signed and Sealed this

Twenty-sixth Day of July, 1994

Bruce Lehman

*Attest:*

BRUCE LEHMAN

*Attesting Officer*

*Commissioner of Patents and Trademarks*